United States Patent [19]

Nowicki

[11] Patent Number: 4,534,153

[45] Date of Patent: Aug. 13, 1985

[54] METHOD AND APPARATUS FOR PACKING PLASTIC BOTTLES

[75] Inventor: Casimir W. Nowicki, Sylvania, Ohio

[73] Assignee: Owens Illinois Inc., Toledo, Ohio

[21] Appl. No.: 512,309

[22] Filed: Jul. 11, 1983

[51] Int. Cl.[3] ..... B65B 5/06; B65B 35/44

[52] U.S. Cl. ..... 53/448; 53/247; 53/252; 53/473; 53/543; 198/412

[58] Field of Search ..... 53/243, 247, 248, 249, 53/250, 251, 252, 258, 443, 448, 473, 531, 543, 53/537, 566; 198/410, 412

[56] References Cited

U.S. PATENT DOCUMENTS

| | | | |
|---|---|---|---|
| 3,566,574 | 3/1969 | Salwasser | 53/543 |
| 4,048,783 | 9/1977 | Raudat et al. | 53/543 |
| 4,224,781 | 9/1980 | Salenbo | 53/249 |

*Primary Examiner*—Robert L. Spruill
*Assistant Examiner*—Richard M. Mudd

[57] ABSTRACT

A system for the handling of lightweight plastic containers into and through a case-packing operation wherein the containers are moved in a single line onto a conveyor where a diverting guide will move the containers into a multiple lane receiver. The multiple lane receiver is rotatable about its longitudinal axis through a 90° angle, either with the container bottoms facing to the left or facing to the right. On the left side of the receiver, a carton-handling arrangement tips a carton toward the containers which are held in the receiver. A pusher mechanism moves the containers, as a group, from the receiver into the carton, and the carton is then returned to its original position.

18 Claims, 9 Drawing Figures

METHOD AND APPARATUS FOR PACKING PLASTIC BOTTLES

BACKGROUND OF THE INVENTION

Case packers for bottles in the past have been primarily designed to handle glass bottles which, although becoming lighter in weight, have traditionally been relatively heavy when compared to the recently produced plastic bottles such as those used for packaging detergents and other household liquid products. In order to handle the relatively heavy glass bottles, the case-packing equipment usually required heavy, expensive machine elements. Furthermore, when handling glass, it has been found necessary to pack the glass in cartons which have dividers spanning the space within the carton, to divide and separate the glass containers one from another due to their fragile nature. These dividers and cartons normally are provided by the glass manufacturer, inasmuch as it is necessary for the glass manufacturer to ship the empty bottles to the user. The user then fills the bottles with its product and reships the filled bottles in the same cartons with dividers which were provided by the glass manufacturer.

When dealing with plastic bottles, again the bottle manufacturer usually supplies the bottles to the user in cartons typically made of corrugated board. But in the case of plastic bottles, depending on the product being bottled, it may or may not require dividers to be present within the carton to separate the bottles one from the other.

It is therefore an object of the present invention to provide an automatic case-packing system in which plastic bottles are moved in a single line to an assembly area where the bottles are assembled into a carton-filling array, then inserted within the carton and the carton then being moved away from the assembly area. Here again, the cartons are brought to the assembly area also in a generally automatic fashion without requiring handling by a large number of people.

It is a further object of this invention to provide a case-packing method for plastic bottles, which can be carried out with relatively inexpensive equipment compared to the equipment for handling heavier glass containers.

Other and further objects will be apparent from the following description.

SUMMARY OF THE INVENTION

The apparatus and method for packing a plurality of containers in a carton wherein the containers are moved in single file into the entrance to the case packer, and then directed into a multiple lane receiver with means for moving the series of containers in an upright attitude into each of the lanes of the receiver. The receiver grips each of the bottles that are held in the lanes and is then rotated through 90° about a horizontal axis which is parallel to the lanes of the receiver, into facing relationship to an open carton, which is supported on a stand adjacent the receiver. The carton stand has an upper supporting structure which grasps the carton and rotates or tilts the carton from its normal bottom down position into position where its open top is facing the held bottles in the receiver. The bottles are then pushed from the receiver into the carton, whereby a full compliment of bottles from the receiver are transferred to the interior of the carton as a unit.

DETAILED DESCRIPTION OF THE DRAWINGS

In the packing of bottles or containers in cartons in the past, glass containers were usually packed within cartons that have dividers or separators, and the systems for packing have relied generally upon the mass of the glass working through gravity to provide the insertion of the containers into the cartons. The cartons normally were moved below the glass accumulating area. With plastic bottles, however, and in particular empty plastic bottles, these bottles are quite light, and as such, gravity in and of itself may not be sufficient to provide the impetus necessary to assure that the bottles will be completely positioned within the cartons, as might be the case with glass bottles. Furthermore, since plastic is light, the movement of the plastic bottles at relatively fast rates of speed is difficult to accomplish and, generally speaking, necessitates the handling of the bottles at a moderate rate of speed. Otherwise, the bottles may begin to leave the surface of conveyors and otherwise become difficult to guide and control through handling systems.

Figure 1:
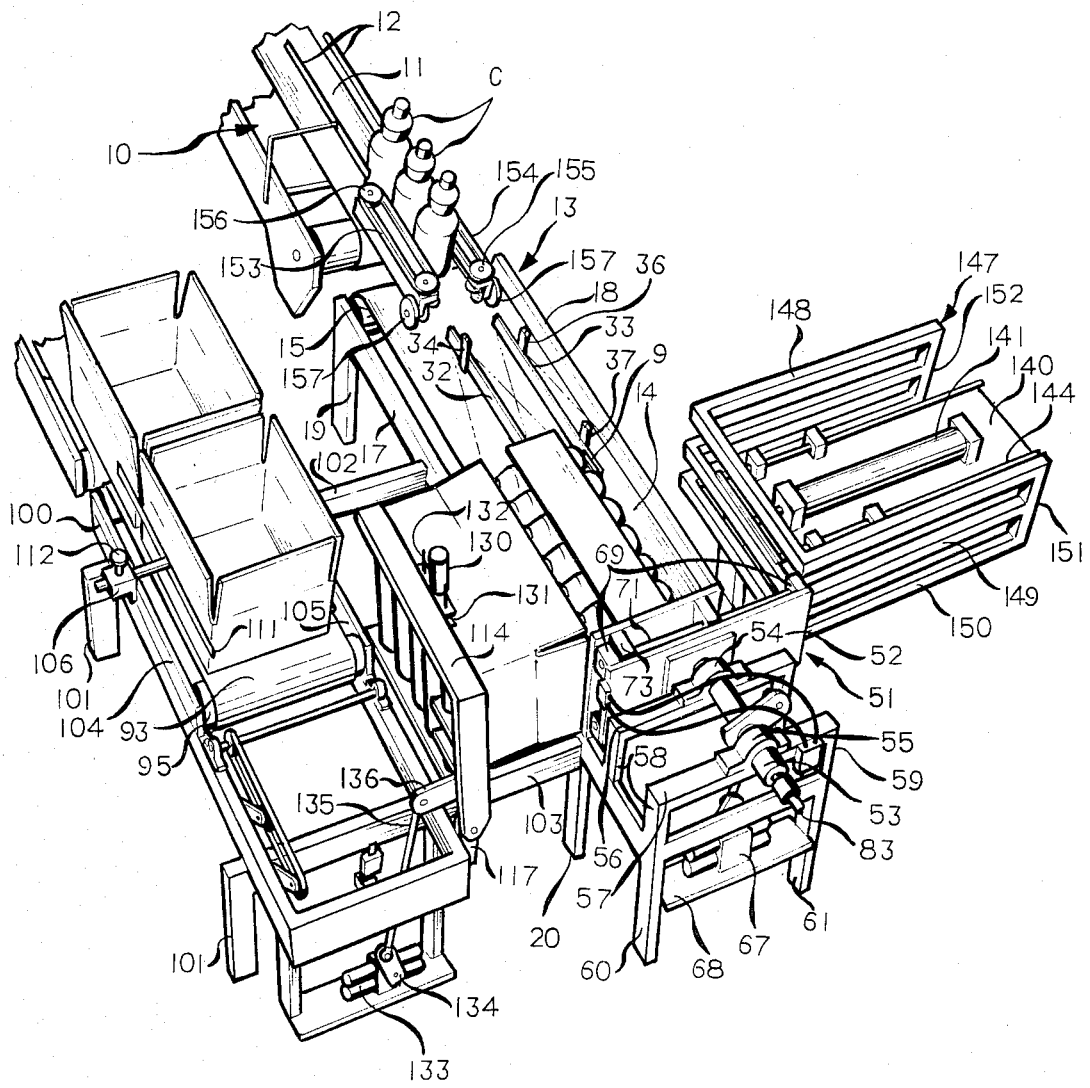
FIG. 1 is a schematic perspective view of the apparatus of the invention with an overhead portion removed.
Figure 2:
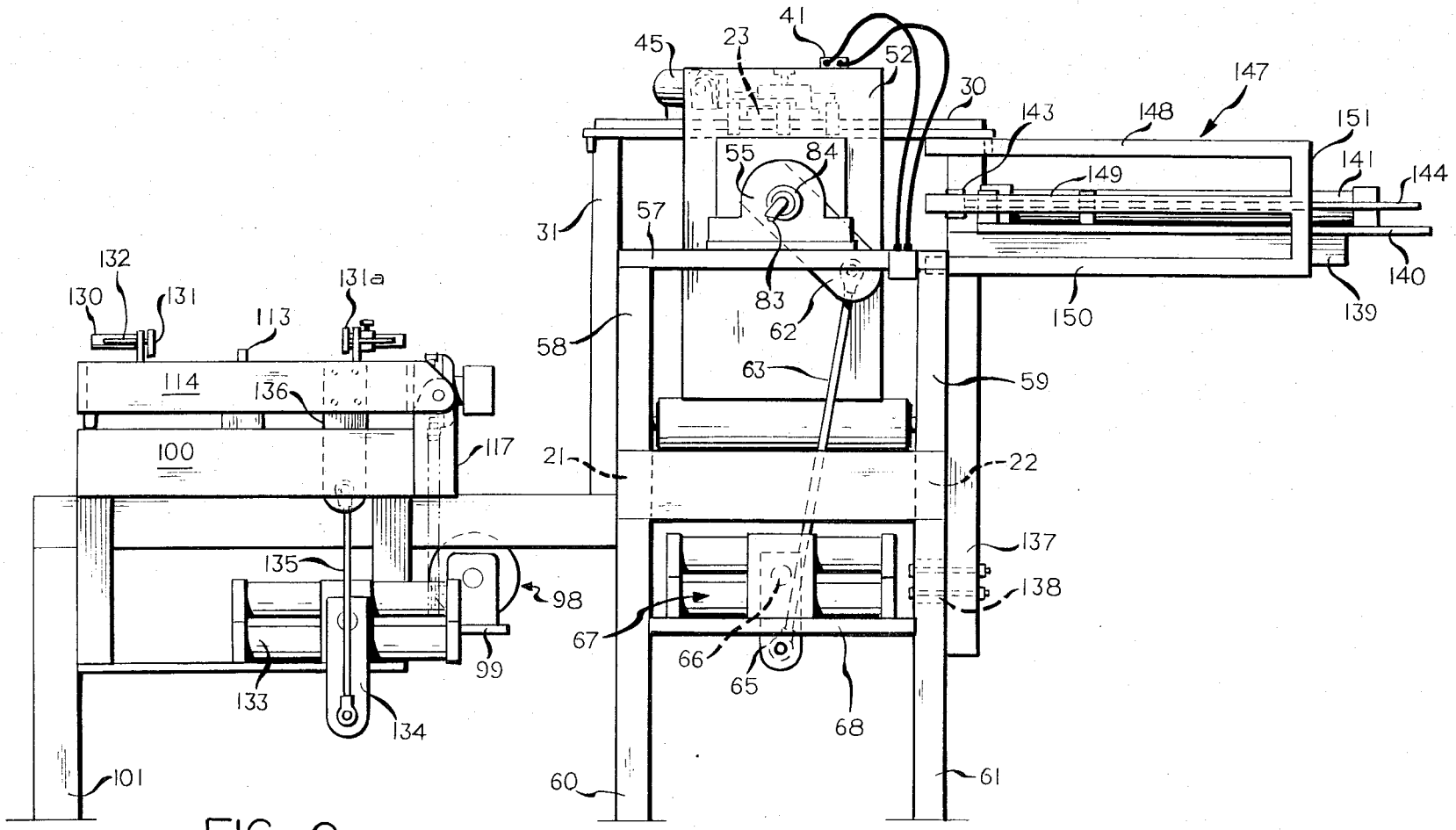
FIG. 2 is an end view of the apparatus shown in FIG. 1, on an enlarged scale.
Figure 3:
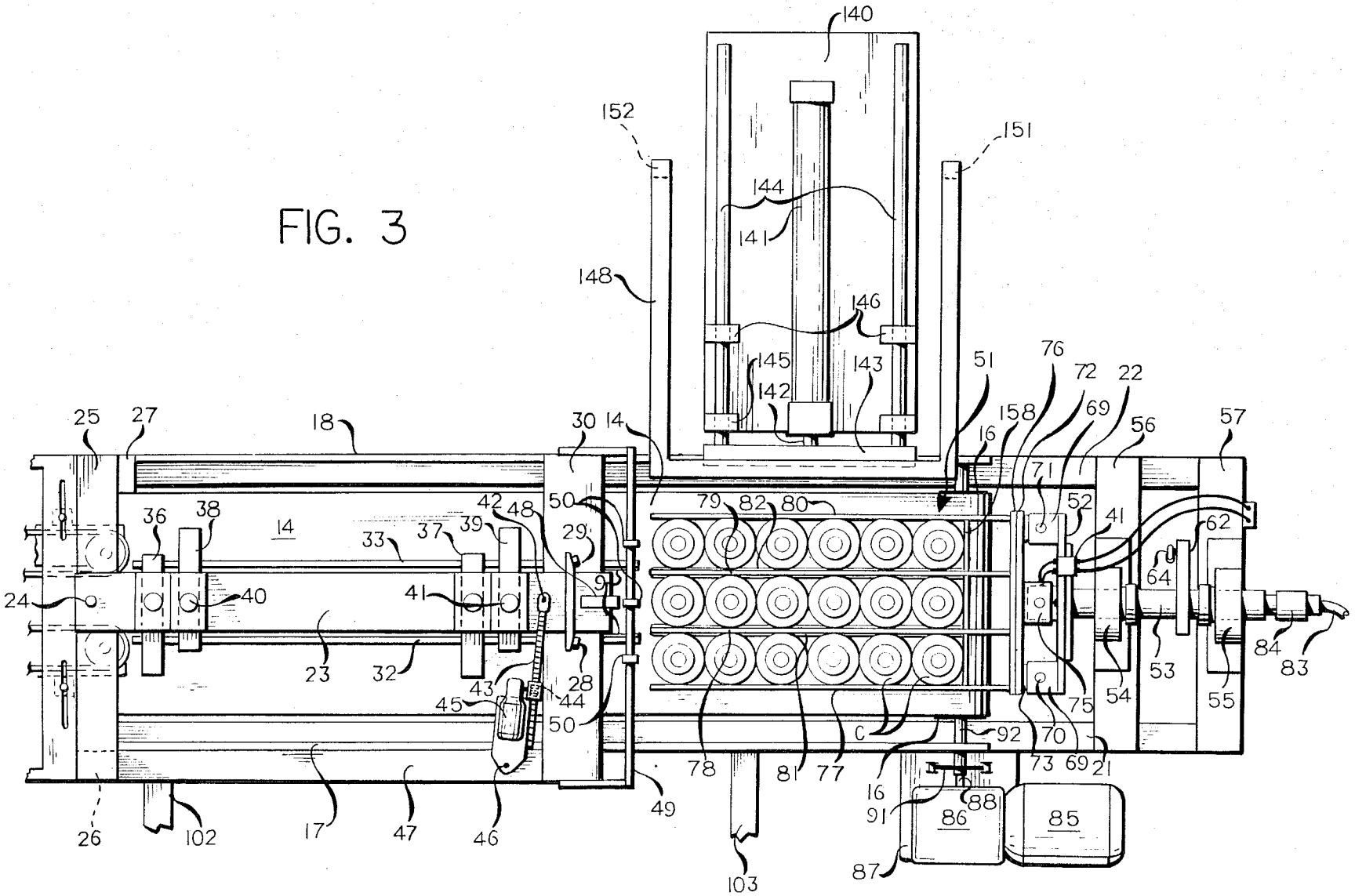
FIG. 3 is a top plan view of the bottle receiving and handling portion of the invention.
Figure 4:
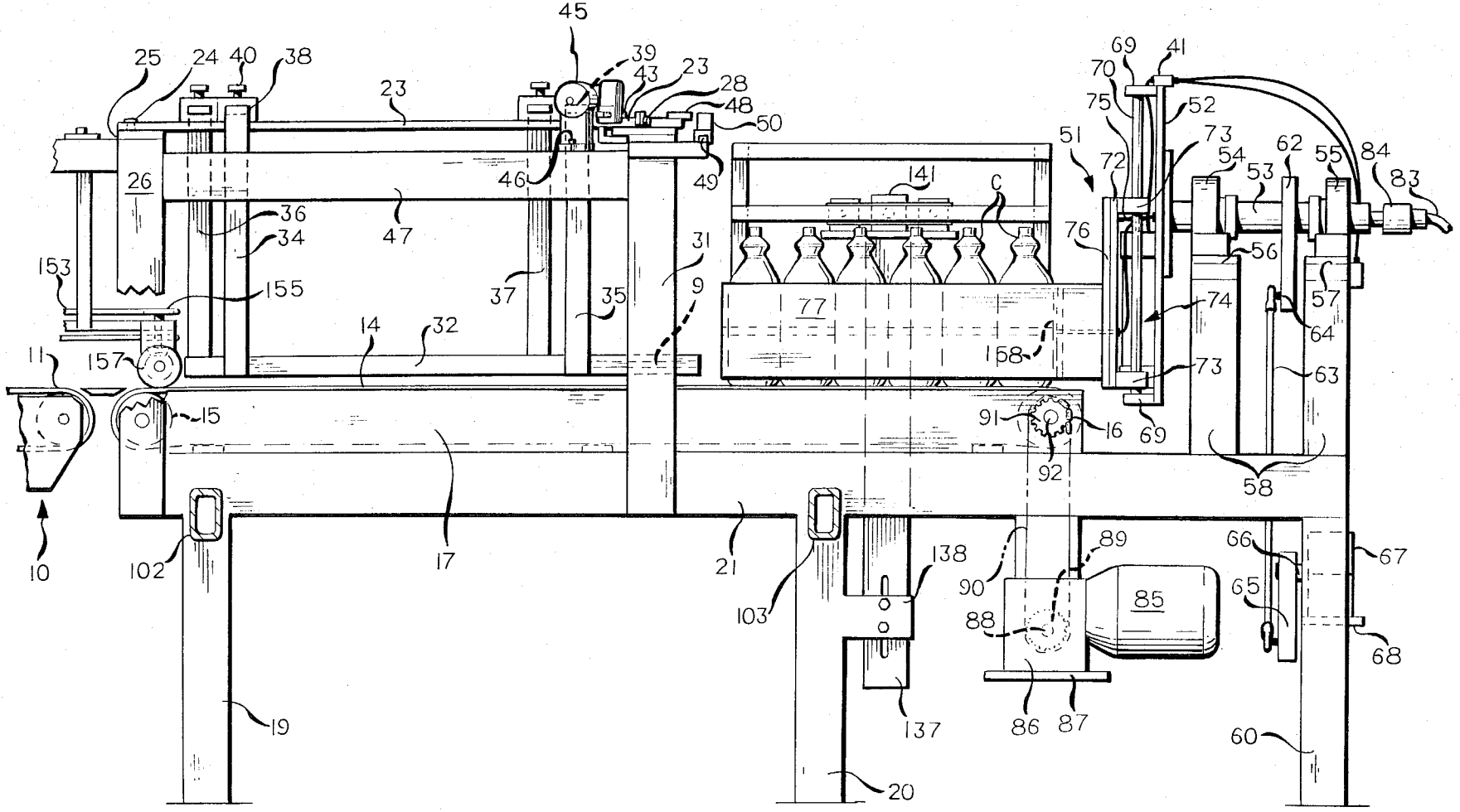
FIG. 4 is a side elevational view of the apparatus of FIG. 3.

Turning now to FIGS. 1–4 in particular, it can be seen that the present invention includes an incoming conveyor 10 having a moving belt 11 moving from the upper left to the lower right, as viewed in FIG. 1, carrying a series of containers C thereon. As the containers move along on the belt 11, they are guided by side rails 12. The forward end of the conveyor 10 is positioned closely to the rearward end of a conveyor 13. The conveyor 13 has a relatively wide belt 14, which is driven in the same direction as belt 11. The belt 14 passes over an idler roll 15, which is adjacent to the forward end of the conveyor 10. The idler roll 15 supports the belt 14 along with a drive roll 16, positioned adjacent the forward end of the apparatus as best shown in FIGS. 3 and 4. Both the rollers 15 and 16 are supported in elongated side plates 17 and 18. The plates 17 and 18 are actually mounted on elongated frames 21 and 22, which extend the full length of the machine. The frames 21 and 22 are supported from the floor by legs 19 and 20. An overhead beam 23 is positioned above the first portion of the conveyor belt 14. The beam 23 is pivoted at point 24 to a cross-beam 25. The cross-beam 25 is supported above the conveyor 13 by vertical support members 26 and 27.

The forward or right hand end of the beam 23, as viewed in FIGS. 3 and 4, carries a pair of small rollers 28 and 29. These rollers 28 and 29 rest on the top surface of a cross-beam 30. The cross-beam 30 is supported at its elevated position by suitable vertical members 31 connected at their lower ends to the side frames 21 and 22. Overlying the conveyor 14 are a pair of spaced-apart, bottle-directing guide rails 32 and 33. The guide rail 32 is connected to the lower end of two vertically, upwardly-extending bars 34 and 35. The upper ends of the bars 34 and 35 are bent toward the rear, as viewed in FIG. 4, with the bent portions 38 and 39, respectively, extending generally horizontally parallel to the surface of the belt 14. The portions 38 and 39 of the bars 34 and 35 are clamped relative to the bar 23 by thumb wheel screws 40 and 41. Loosening of the thumb wheel screws 40 and 41 will permit the ends 38 and 39 of the support for guide rail 32 to be shifted relative to the opposite guide rail 33. In a like manner, bars 36 and 37, which support the other guide rail 33, are adjustably mounted relative to the beam 23. Thus, it can be seen that the spacing between the rails 32 and 33 may be adjusted as desired, and as would be expected when considering the present invention, has the ability to handle bottles of various diameters. In the position shown in FIG. 3, those bottles which are moved by the conveyor 14 will be moved into a straight line extending down through the center of the mechanism.

The overhead beam 23, as previously explained, is pivoted at 24, its left end, and at its forward end is supported by a pair of rollers 28 and 29 relative to a cross-beam 30. This forward end of the beam adjacent the rollers 28 and 29 is provided with a pivot connection 42 to one end of a generally horizontally-extending rack 43. The rack 43 has an intermediate portion thereof in engagement with a drive pinion 44. The pinion 44, in turn, is connected to an electric motor 45 through a suitable gear reduction transmission (not shown). The motor 45 also is mounted so as to pivot at 46 relative to an upper beam 47, which extends between the support 26 and the vertical member 31.

Operation of the motor 45 will drive the rack 43 either toward the top or toward the bottom, as viewed in FIG. 3, depending on the direction of rotation, and incident to this movement of the rack 43, the overhead beam 23 will be shifted so as to bring the guide rails 32 and 33 into alignment with the left hand side of the conveyor or the right hand side of the conveyor, as desired. Shifting of the beam 23 by the operation of the motor is under the control of a proximity detector 48 carried at the extreme end of the beam 23. This proximity detector 48 is sensitive to magnetic material and, as seen in FIG. 3, an aluminum cross rail 49 carries three spaced-apart steel members 50. These members 50 comprising adjustable position indicators may be adjusted along the length of the cross rail 49 to various positions as desired, it being understood that the motor 43 will drive the beam 23 in the direction of either steel member 50 until the proximity switch 48 indicates that it has moved to that position opposite one of the steel members, at which time the rail drive will be stopped to bring the rails 32 and 33 into alignment with one of the lanes formed in a receiver, generally designated 51, positioned at the right hand end of the conveyor 14.

The receiver 51 is generally formed of a flat vertically-oriented plate 52, which is connected to the left hand end of a hollow spindle 53. The spindle 53 is supported with its axis horizontal by a pair of bearing blocks 54 and 55. The bearing blocks 54 and 55 are each supported on horizontal beams 56 and 57. These beams 56 and 57 are supported at their elevated position relative to the frame 21 by vertical supports 58 and 59 at the respective ends thereof. These supports 58 and 59 extend down to and are, in turn, carried on the side frames 21 and 22, which extend the full length of the receiver area. The frames 21 and 22, at their right hand end as viewed in FIGS. 2, 3 and 4, are supported on legs 60 and 61 from the floor.

The spindle 53 has a crank arm 62 fixed thereto. The crank arm 62 has a driving rod 63 pivotally connected thereto at 64. The lower end of the rod 63 in turn is pivotally connected to a crank arm 65. The crank arm 65 is rotatable about a shaft 66, which is the output shaft of a dual hydraulic cylinder rotary actuator sometimes termed a rotameter 67. The rotameter 67 is a purchased item consisting essentially of two vertically-spaced, horizontal piston driven racks, driven in opposite direction with the racks in engagement with a centrally positioned spur gear, which is mounted on the output shaft 66. The rotameters are a purchased item from T.H.D. Inc., Fort Wayne, Ind. Needless to say, the actuation of the rotameter causes the crank 65 to be rotated essentially through a chosen angle, depending on the desired angle of rotation, and in the present situation will drive the shaft 66 and the crank arm 65 with the crank arm 62 moving through an angle of 90°. Thus, it can be seen that the plate 52 of the receiver 51 will be rotated through 90° in a counterclockwise direction about the axis of the spindle 53, upon actuation of the rotameter, from the position shown in FIGS. 2–4. The rotameter 67 is supported between the legs 60 and 61 on a cross member 68.

Figure 9:
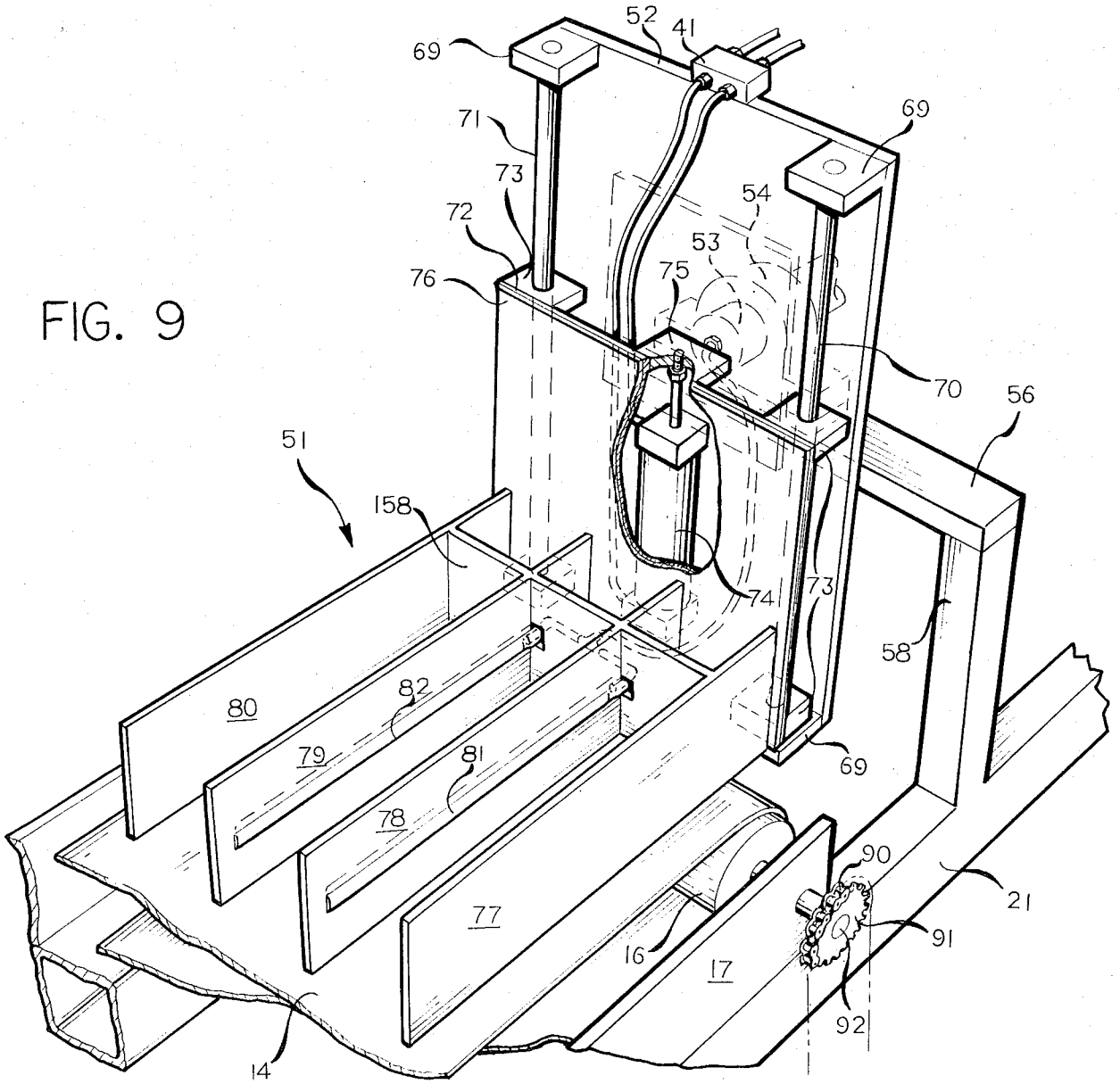
FIG. 9 is a perspective view, on an enlarged scale, of the bottle receiver and rotating mechanism of the invention as viewed from the left in FIG. 3.

The plate 52, which is carried at the left hand end of the hollow spindle 53, and as best shown in FIG. 9, is provided on its left hand face with four blocks 69 positioned at the four corners thereof. The two vertically-aligned blocks 69 at each side of the plate 52 serve to support vertical guide shafts 70 and 71. The guide shafts 70 and 71 serve to guide a plate 72 which has four bearing blocks 73 positioned at the four corners thereof in a manner similar to the blocks 69 of the plate 52. The plate 72, as viewed in FIG. 4, is vertically movable relative to the plate 52, and in this vertical movement is guided by the blocks 73 and the shafts 70 and 71. Movement of the plate 72 is under the control of an air motor 74, which is mounted to the face of the plate 52 and has an output shaft connected to a bar 75 fixed to the back of the plate 72. The left hand face of the plate 72 carries a mounting plate 76 thereon.

The mounting plate 76, shown specifically in FIGS. 3 and 4, and also in FIG. 9, carries four horizontally-extending, lane-defining bottle guide plates 77–80. The two outside plates 77 and 80, as viewed in FIG. 3, are metal plates having significant height relative to the containers C which are to be guided thereby. The inner two plates 78 and 79 are generally of the same size as the plates 77 and 80. However, along the length thereof, at a position between one-third and one-half the height thereof, these plates have inflatable tubes extending in a horizontal gap therein, the tubes being numbered 81 and 82. The tubes 81 and 82 are of a normally flattened configuration with sides parallel to the plates but which, upon inflation, will expand outwardly, and by such expansion will grip the sides of the containers C that are positioned within the three lanes shown. The tubes 81 and 82 are inflatable by the introduction of air under pressure through a pipe 83, which is connected to a suitable source of air under pressure (not shown). The pipe 83 is connected through a rotary joint 84 to the interior of the hollow spindle 53. The opposite end of the spindle 53 is connected by a flexible connection to the ends of the tubes 81 and 82. While the tubes 81 and 82 are of a flattened configuration with the principal plane of the inflation being radially outward toward the bottles or containers held in the lanes, it has been found that, upon relaxation or discontinuance of the air under pressure, in some instances the tubes do not flatten back to their original shape. Thus, Applicant has found that it is advantageous to be able to provide vacuum through the pipe 83 as desired. When the bottles are being released, the air under pressure at 83 may be discontinued and a vacuum introduced through the pipe 83 to completely collapse the tubes 81 and 82. Further, vacuum may be introduced to the tubes as the bottles are being moved into the receiver 51.

The belt 14 which extends beneath the guide plates 77–80, as best seen in FIGS. 3 and 4, is driven by a motor 85 and gear box 86, mounted as a unit on a platform 87 suspended from the frame 21. The gear box 86 has an output shaft 88 on which is mounted a sprocket 89. The sprocket 89 drives, through a chain 90, a sprocket 91 that is fixed to a shaft 92, which supports the roll 16 and the belt 14.

Thus, it can be seen that bottles which are moved onto the belt 14, moving in the direction of the receiver 51, will be confined between the guide rails 32 and 33 so that they will enter the receiver in one of the three lanes as shown in FIG. 3. Shifting of the guide rails 32 and 33 is under the control of an optical system which will sense when the row or lane is full and then shift the lane or rails 32 and 33 either to the left or right, depending on which of the lanes is empty, and will remain in that position until the lane has filled with bottles, at which time again the rails 32 and 33 will be shifted. As each of the lanes, three in number as shown in FIG. 3, are filled with bottles, inflatable strips 9 at the ends of rails 32 and 33 will inflate to grip the bottle and stop the flow.

Figure 5:
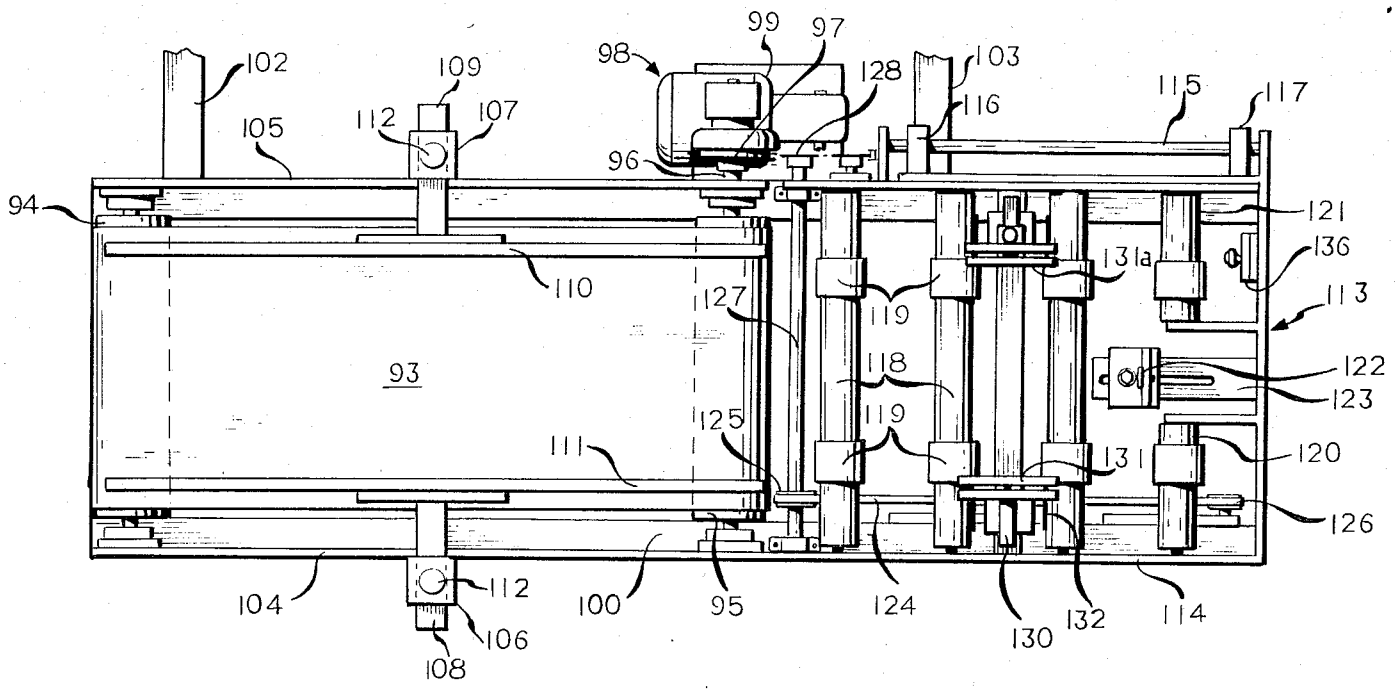
FIG. 5 is a top plan view of the carton-handling portion of the invention.
Figure 6:
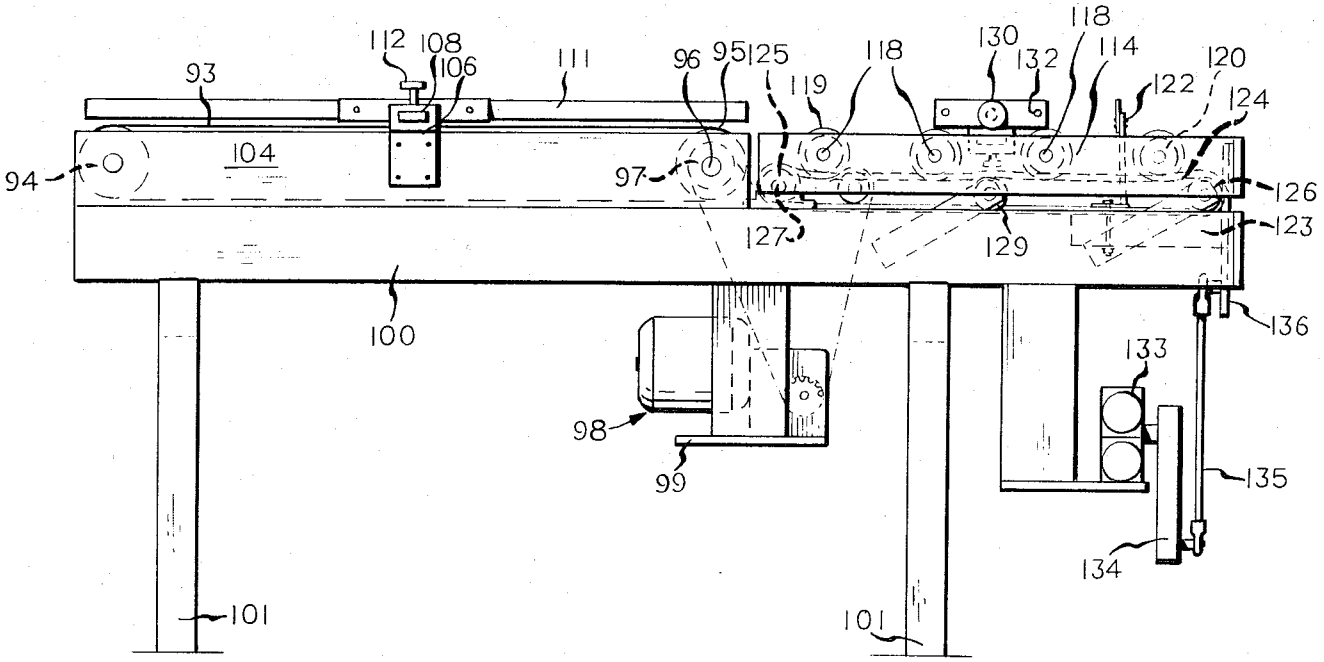
FIG. 6 is a side elevational view of the apparatus of FIG. 5.

Concurrently, with the movement of the bottles into the receiver 51, empty cartons, either under the influence of gravity or by a drive-powered belt, are moved onto the end of a belt 93 of a carton-advancing and handling system shown in FIGS. 5 and 6. The belt 93 is supported in its horizontal position by a pair of spaced-apart rollers 94 and 95. The roll 95 is connected by a shaft 96 to a chain-driven sprocket 97. An electric motor and gear box combination, generally designated 98, is mounted on a horizontal platform 99 below the carton-supporting frame member 100. The frame member 100 takes the general shape of a rectangular frame supported above the floor by legs 101. A pair of horizontally-extending beams 102 and 103 extend outwardly from the side of the frame 100 on that side facing the bottle handler. These beams 102 and 103 have their outer ends connected to the frame 21 of the bottle receiver support. The two rolls 94 and 95 are rotatable on shafts that are supported at opposite ends in a pair of plates 104 and 105.

These side plates 104 and 105 have brackets 106 and 107 extending above the top edge thereof as shown in FIGS. 5 and 6. The brackets 106 and 107 carry horizontally-extending arms 108 and 109, respectively, to which are mounted carton guide rails 110 and 111. The brackets 106 and 107 carry round thumb wheel screws 112. These thumb wheel screws 112 may be loosened and the arms 108 and 109 may be shifted toward each other to set the rails 110 and 111 at any desired spacing, depending upon the width of the carton being conveyed by the conveyor 93. To the right of the position of the belt 93, the frame 100 carries a hinged frame 114 which serves as a carton-supporting structure, generally designated 113. The frame 114 is rectangular in configuration and is hingably movable about a fixed, horizontal shaft 115 supported by fixed bearing members 116 and 117.

The sides of the cartons supporting frame 114 serve as the support for three horizontal rollers 118. The rollers may be made of any suitable lightweight material. Around each of the rollers, at spaced intervals, are applied two nylon or plastic sleeves 119. These sleeves provide good frictional engagement with the bottom of a carton and assist in moving the cartons as they are driven by the belt 93 onto the rollers 118. At the right hand end of the frame 114, the roller that would be comparable to a roller 118 is divided into two axially aligned rollers 120 and 121 so as to provide room for an adjustable stop member 122 mounted on an angle bracket 123, which is fixed to the right hand end of the frame 100. The rollers 118 are powered by an endless belt 124, which extends between a pair of pulleys 125 and 126. The endless belt 124 has its upper reach in frictional engagement with the under surface of each of the rollers 118. The pulley 125 is mounted to a horizontal shaft 127, which carries a sprocket 128 on one end thereof. The sprocket 128 is driven by the same chain which drives the roll 95. The belt 124 is supported midway along its length by an idler pulley 129. This idler pulley holds the belt up in the area between the two rollers 118 and keeps it in frictional engagement therewith.

As previously explained, the carton-supporting structure 113, and in particular the frame 114, is rotatable about the axis of the shaft 115, thus carrying the rollers 118 with it as it is pivoted. However, by the run of the belt 124 engaging the bottom of the rollers 118, each of the rollers 118 serves to move a carton which is initially moved into engagement with the first roller by the belt 93 to the position where the carton or box will engage the stop 122. When the carton has reached the stop 122, and preparatory to moving the carton support about the shaft 115, an air motor 130, supported by the side of the frame 114, is actuated to move gripping plate or bar 131 into engagement with the side of the carton to clamp the carton against an adjustable, stationary bar **131*a*. The bar 131 has guide rods 132 extending outwardly therefrom, and these rods in turn pass through openings in the motor support frame, and thus prevent rotation of the bar or plate 131 relative to the carton-supporting structure 114 during the clamping action of the plate 131. When the plates 131 and 131*a* have engaged the carton and hold it grasped therebetween, the frame 114 will be shifted about the axis of the shaft 115 by the operation of a rotameter 133 mounted beneath the frame 100. The rotameter has an output arm 134 pivotally connected to a drive rod 135. The drive rod 135, at its upper end, is pivotally connected to a member 136, which extends downwardly from and is mounted to the frame 114**.

Thus, it can be seen that by actuation of the rotameter 133 the frame 114 will be shifted about the axis of the shaft 115 into the position specifically shown in FIG. 1. When the carton has assumed the position shown in FIG. 1, and the receiver also has been rotated through 90° to assume the position as shown in FIG. 1, the containers held by the receiver are now ready to be moved from the receiver into the carton as an entire group. As shown in FIG. 1, the bottles have been turned such that their necks are facing in the direction of the carton.

The mechanism for shifting the bottles from the receiver into the carton is shown to the right, as viewed in FIG. 2, of the receiver-handling portion of the apparatus. The pusher is supported by a vertically adjustable post 137 bolted to a bracket 138 carried by the leg 20 at the right hand side of the receiving support mechanism. The leg 20 extends down from the frame 22. The upper end of the post 137 carries a horizontally-extending bar 139. The upper surface of the bar 139 supports a flat, rectangular plate 140. The upper surface of the plate 140 has an elongated air motor 141 mounted thereon. The air motor 141 has its output piston rod 142 connected to a horizontal cross arm 143. The cross arm, at its horizontally-spaced ends thereof, carries a pair of horizontal guide rods 144. The guide rods 144 extend rearwardly, parallel to the piston rod 142 and are guided in a pair of spaced-apart guides 145 and 146 mounted to the surface of the plate 140. In this manner, the cross arm 143 may be reciprocated horizontally by the motor 141 without the arm turning about the axis of the piston rod 142. A pusher frame, generally designated 147, consists of three generally U-shaped frame members 148, 149 and 150. These members 148, 149 and 150 are connected together at their rearward ends by vertical bracing members 151 and 152. The U-shaped members 148, 149 and 150 may be fabricated as a single unit with the bracing members 151 and 152. The horizontal run of the middle member 149 is releasably connected to the cross arm 143. The pusher frame 147 will be actuated by the motor 141 to move the three U-shaped frame members 148, 149 and 150 into engagement with the containers held by the receiver 51, and push the containers from the receiver 51 into the carton, which is supported and held by the frame 114.

Figure 7:
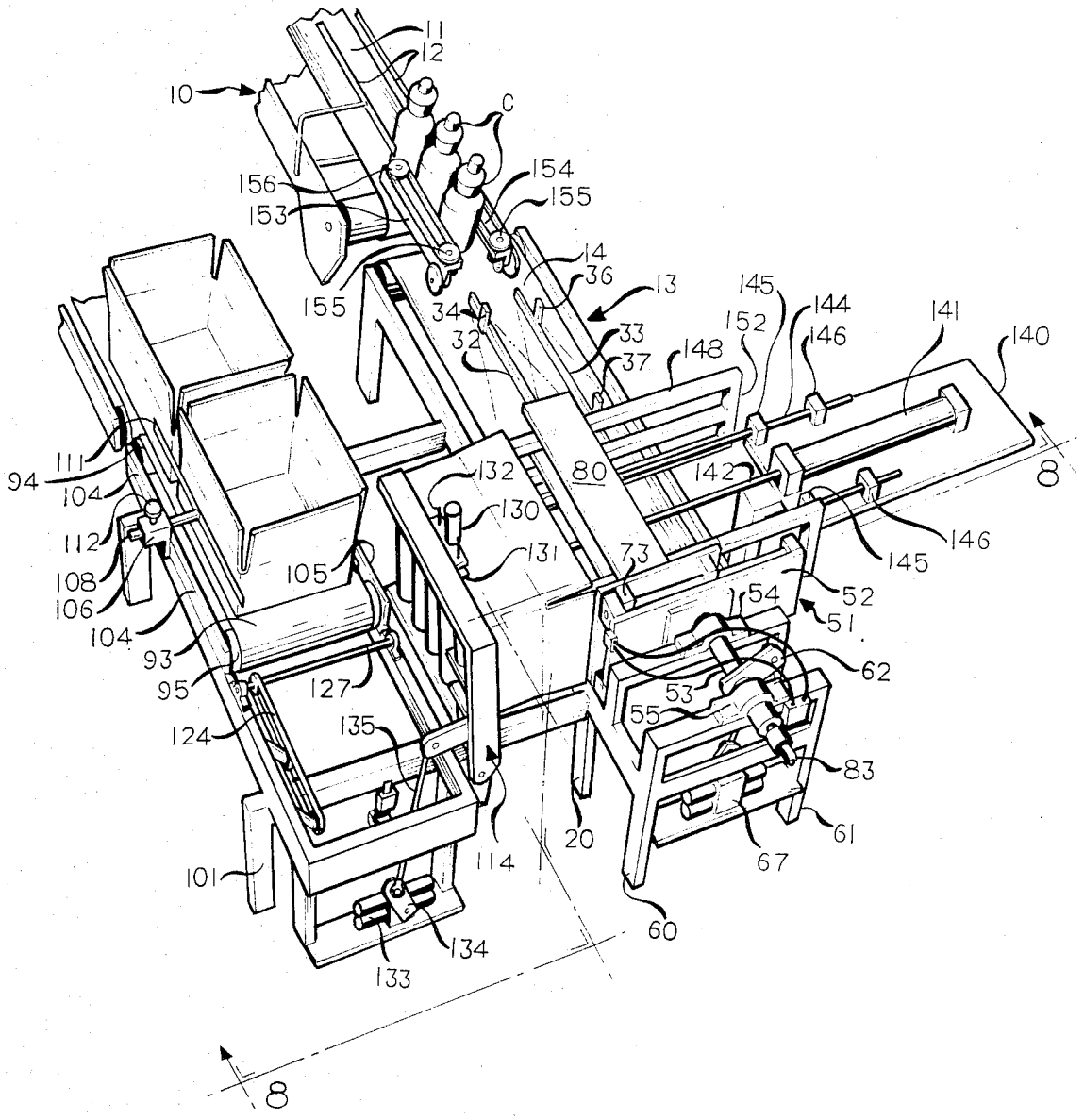
FIG. 7 is a perspective view similar to FIG. 1, showing the position of the apparatus after the bottles have been transferred to the carton.
Figure 8:
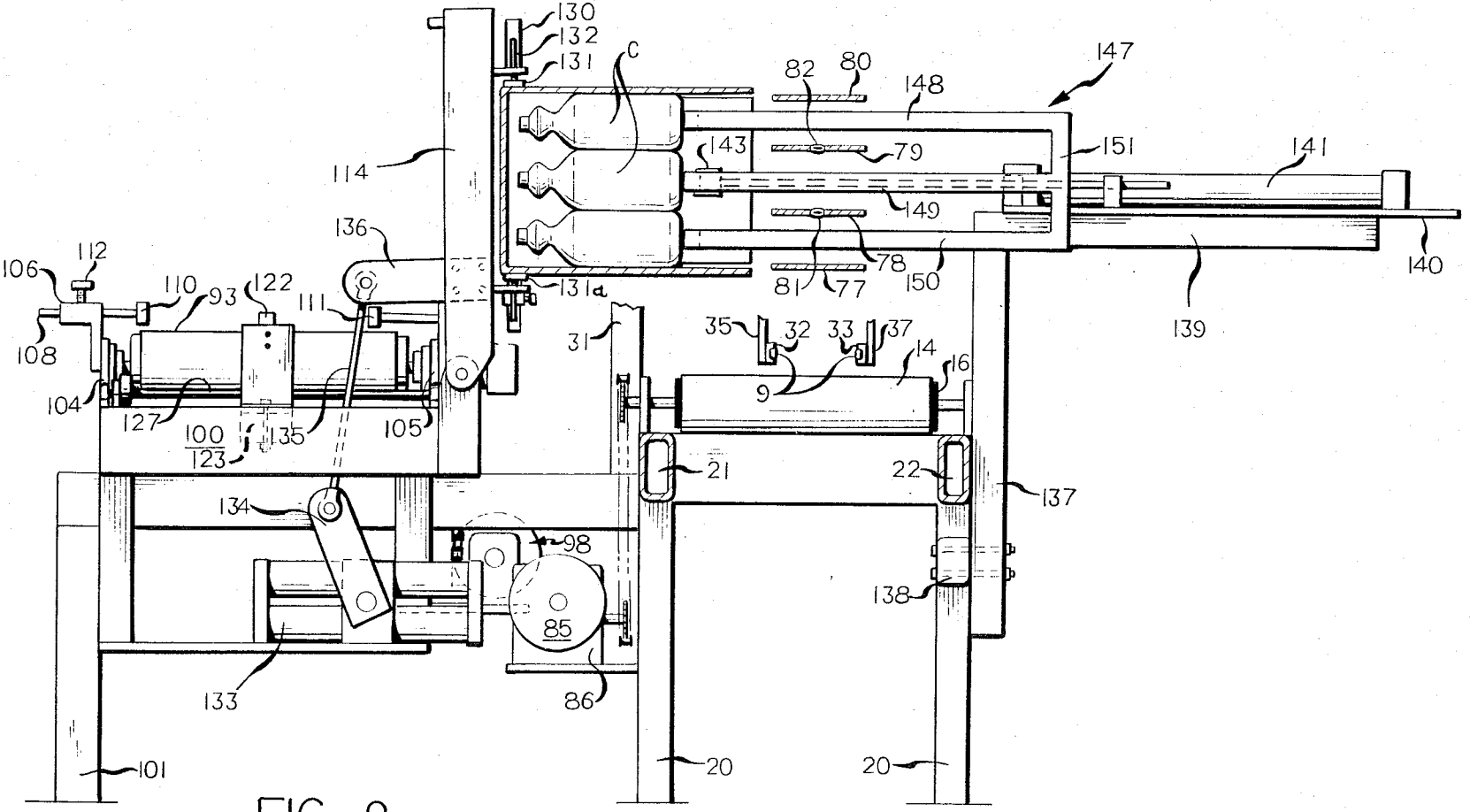
FIG. 8 is a part end elevation and part vertical, sectional view, on an enlarged scale, taken along the line 8—8 of FIG. 7.

This movement of the pusher frame 147 is illustrated in FIG. 7, where it is shown in its fully extended position, and has pushed the bottles from the receiver 51 into the carton. When the bottles have been moved to the position, as illustrated specifically in FIG. 8 and as illustrated in the perspective view FIG. 7, the motor 141 will be reversed and the frame 147 will be retracted back to its original position. Likewise, the frame 114 supporting the carton will be returned to its bottom down position by reverse operation of the rotameter 133. When the frame 114 has been restored to its original position with the carton sitting upright thereon, the filled carton may be moved from the frame 114 by retracting the stop member 122 and having the carton rolled forward onto a skate wheel type of conveying system (not shown). Thus, the entire packing mechanism will be ready to receive another grouping of containers and another carton to be filled with the grouping of containers.

The containers that are traveling along the single line conveyor 11 are assisted from the conveyor 11 onto the belt 14 by a pair of side-engaging belts 153 and 154. These belts extend over and about pulleys 155 and 156. The pulleys 155 at the exit end of conveyor 10 and the inlet to the conveyor 14 are mounted on vertical shafts which are geared to and driven by a pair of wheels 157. The wheels 157 press against the belt 14 and are rotated by the movement of the belt 114. Thus, when the belt 14 is moved or driven forward by the motor 85, the small belts 153 and 154 will be rotated in the direction to advance the containers C into the entrance of the gap between the rails 32 and 33.

While the foregoing description illustrates an arrangement of containers where there are six in a row and provided in three rows, it should be kept in mind that a lesser number of containers in each row might be packed simultaneously with the only consideration being that to accommodate a lesser length of containers or number of containers in each lane, a different set of guide plates with an end stop 158 moved to the left, as viewed in FIG. 3 and in FIG. 9, could be substituted. Furthermore, to accommodate perhaps four rows rather than three, a different set of bottle guide plates would be installed relative to the mounting plate 76. Likewise, for accommodating a different size carton, the carton guides and carton clamping system is provided with adjustment. Obviously, it would be necessary to change the pusher frame 147 to one of a different size or length to compensate for a lesser length row of containers or for a different number of rows. It should be kept in mind, however, that the carton will be moved to an adjustable stop position during its normal operation, and the containers will be moved lane by lane into the receiver to the extent permitted by the end stop 158, so that the forward edge of the carton frame 114 will be the determining position for that edge of the carton in all adjustments for boxes of different sizes. By the same token, the initial forward edge of the lanes in which the receiver receives containers will be opposite that portion of the carton frame which is positioned correctly.

While the foregoing description has been with respect to the positioning and insertion of the container's neck down into the cartons and the cartons are shown as not having bottle partitions therein, it should be pointed out that providing partitions within the carton prior to its arrival at the packing station may be accomplished, and that the containers which are moved neck down into the cartons generally accommodate themselves quite well to cartons that have partitions in them. Furthermore, because of the precise locating of the containers in the receiver and the precise location of the receiver relative to the carton, the bottles, when being moved with their bottoms in the direction of the carton, also may be easily loaded automatically into a carton carrying the partition members therein. If the bottom first loading of bottles in a carton with partitions therein becomes desirable, and the bottles have a tendency to hang up on the partitions, the interposition of a plural funnel guide between the tilted carton and the rotated receiver is contemplated. Such funnel guide would be set with the typical flexible, funnel-like guiding members held in an array as they are on case packers for glass bottles. However, in the present case, the funnels will have horizontal axes in alignment with the carton and the bottles.

Furthermore, if it is desirable to load the containers with their bottoms toward the bottom of the carton, it is only necessary to change the connection of the crank arm 62 from the position, as shown in FIG. 2, to a clockwise position 90° removed from that shown and then the plate 52, which carries the receiver, will turn 90° in the opposite direction. It should be remembered that the motor 74 is first actuated to raise the bottles so they will clear the conveyor 14 before the plate 52 is rotated. After the receiver frame 52 has been turned through 90°, the motor 74 carried by the frame is actuated, if necessary, to move the assemblage of containers held by the guide plates toward the carton facing end of the plate 52. This operation happens regardless of whether the plate 52 is set up such that it is rotated in a counterclockwise direction, as specifically shown in the Figures of the drawings accompanying this case, or in an opposite direction as explained above when loading containers in the carton with their bottoms down.

I claim:

1. Apparatus for packing a plurality of containers in a carton wherein the containers are moved in single file into the case packer entrance, comprising a multiple lane receiver, means for directing a series of containers in an upright attitude from said single line into each of the lanes of said receiver, means on said receiver for gripping each of the containers in the lanes, means connected to said receiver for rotating said receiver and the gripped containers through an angle of 90° about a horizontal axis which is parallel to the lanes of the receiver, an open carton supporting stand positioned adjacent said receiver, said stand having an upper supporting structure, means for moving cartons onto said supporting structure, carton grasping means on said structure for engaging the empty carton and holding it on said structure, means mounting said supporting structure on said stand for pivotal movement at about the side thereof adjacent said receiver, means connected to said structure for pivoting said structure through 90° to place the open end of the carton in facing relationship with respect to said rotated receiver, and means for engaging the containers in the receiver for moving the containers from the receiver into the carton, whereby the full complement of containers in the receiver are transferred to the interior of the carton as a unit.

2. The apparatus of claim 1 wherein said means for moving the containers comprises a moving belt conveyor, and a shiftable guide over said conveyor for directing said containers into alternate alignment with the lanes of the receiver.

3. The apparatus of claim 1, wherein said means on the receiver for gripping the containers comprises an expandable strip extending along the length of at least one side of each lane, and means connected to said strips for expanding said strips to affect the gripping.

4. The apparatus of claim 1 wherein said means for moving the containers into the carton comprises a plurality of horizontal bars, equal in number to the number of lanes in the receiver, means supporting said bars in facing relationship to the open carton with the containers therebetween, and means for horizontally reciprocating said bars.

5. The apparatus of claim 1 wherein said receiver comprises a plurality of elongated plates said plates having vertical faces spaced from each other a distance slightly greater than the diameter of the containers to be handled, and means supporting said plates for rotation about a horizontal axis that is symmetrical with respect to the total width of the receiver.

6. The apparatus of claim 1 in which said supporting structure comprises a generally rectangular, horizontal frame and a plurality of rollers spanning the width of said frame.

7. The apparatus of claim 6 further including carton conveying means in advance of said supporting structure, said conveying means comprising a second moving belt conveyor, and means for driving said second moving belt conveyor in the direction of the supporting structure.

8. The apparatus of claim 7 further including a horizontal drive belt supported beneath said rollers and in engagement therewith, and said means for driving said second moving belt conveyor also drives said belt.

9. The apparatus of claim 6, further including a carton stop extending above the plane of the rollers for engaging a carton moved thereon.

10. The apparatus of claim 9, wherein said carton stop is mounted on the stand, and means connected to said stop for adjusting the position of the stop relative to said stand and supporting structure.

11. The apparatus of claim 2 wherein said lane guide comprises a pair of spaced, horizontal rails, and means above said moving belt conveyor for supporting said rails.

12. The apparatus of claim 11 wherein said supporting means for said rails comprises an elongated beam supported above and extending generally in the direction of movement of said moving belt conveyor, and means carried by said beam and extending downward therefrom connected to said rails.

13. The apparatus of claim 12 further comprising means for pivotally supporting one end of the beam adjacent the infeed end of said moving belt conveyor, and means supporting the opposite end of said beam for swinging movement in a horizontal plane.

14. The apparatus cf claim 13, further comprising motor means connected to said beam for swinging said beam through an arc about said one end to thereby align the rails carried thereby with the lanes of the receiver.

15. The apparatus of claim 14, further including a position detector on said movable end of said beam, and adjustable position indicators mounted in the path of movement of said movable end of said beam, said indicators being equal in number to the lanes in said receiver.

16. The apparatus of claim 12, wherein said means extending downward from said beam are adjustably mounted to said beam for adjusting the space between said rails to the diameters of different containers.

17. The apparatus of claim 4, wherein said means for horizontally reciprocating said bars comprises a horizontal piston motor, means connecting the piston rod of said motor to one of the bars, support members connected to said bars, at right angles thereto, and extending horizontally away a predetermined distance, and means connecting the extending ends of said support members together to form a unitary structure.

18. The method of packing a plurality of containers in a carton wherein the containers are moved in single file into the case packer entrance, comprising moving the single file containers in an upright attitude and in a predetermined order into a plurality of adjacent lanes of a receiver, filling the lanes with containers, gripping each of the containers in the receiver, rotating said receiver and the gripped containers through an angle of 90° about a horizontal axis which is parallel to the lanes of the receiver, supporting an open carton on a stand adjacent said receiver, grasping said empty carton and pivoting said grasped carton through 90° to place the open end of the carton in facing relationship with respect to said rotated containers, moving the containers, as a unit, directly from the receiver into the carton and returning the filled carton to its upright position, whereby the full complement of containers in the receiver are transferred to the interior of the carton.

* * * * *